United States Patent [19]

Artzt et al.

[11] Patent Number: 4,497,166

[45] Date of Patent: Feb. 5, 1985

[54] PROCESS AND DEVICE FOR INTERRUPTING AND STARTING THE SPINNING PROCESS AT AN OPEN-END SPINNING POSITION

[75] Inventors: Peter Artzt, Reutlingen; Heinz Müller, Metzingen; Gerhard Egbers; Heinz Neher, both of Reutlingen, all of Fed. Rep. of Germany

[73] Assignee: Schubert & Salzer Maschinenfabrik Aktiengesellschaft, Ingolstadt, Fed. Rep. of Germany

[21] Appl. No.: 453,777

[22] PCT Filed: Apr. 3, 1982

[86] PCT No.: PCT/DE82/00081

§ 371 Date: Dec. 27, 1982

§ 102(e) Date: Dec. 27, 1982

[87] PCT Pub. No.: WO82/04075

PCT Pub. Date: Nov. 25, 1982

[30] Foreign Application Priority Data

May 9, 1981 [DE] Fed. Rep. of Germany ..... 3118382

[51] Int. Cl.[3] ..... D01H 15/00

[52] U.S. Cl. ..... 57/263

[58] Field of Search ..... 57/83, 263, 264, 300–302, 57/405, 408, 411–413

[56] References Cited

U.S. PATENT DOCUMENTS

| | | | |
|---|---|---|---|
| 3,354,631 | 11/1967 | Elias et al. | 57/83 X |
| 4,102,116 | 7/1978 | Derichs et al. | 57/263 |
| 4,156,341 | 5/1979 | Raasch | 57/405 X |
| 4,384,451 | 5/1983 | Elias et al. | 57/263 |

*Primary Examiner*—Donald Watkins

*Attorney, Agent, or Firm*—Dority & Manning

[57] ABSTRACT

To end or start the spinning operation on an open-end spinning unit by means of a switching device with which the connection to a spinning element or a delivery channel is alternately unblocked and blocked during the reversal of a switching device, the fiber flow is taken out of the region of the particular fiber path to be blocked, and only then is this region blocked. To influence the fiber flow, the volumetric flow rates of suction air flowing through the switching device are controlled. The switching device (6) has at least one closing member (60) with a first orifice (61) which leads to the spinning element (1) and the cross-section of which is enlarged geometrically in a discontinuous manner in the direction of the orifice opening, and with a second orifice which leads into the delivery channel (51) and the cross-section of which is reduced geometrically in a gradual way in the direction of the orifice closure.

16 Claims, 11 Drawing Figures

PROCESS AND DEVICE FOR INTERRUPTING AND STARTING THE SPINNING PROCESS AT AN OPEN-END SPINNING POSITION

The present invention relates to a process for ending or starting the spinning operation on an open-end spinning unit, in which the feed of fibers is controlled by means of a switching device, by which the connection to a spinning element or a delivery channel is alternately unblocked and blocked, and to an apparatus for carrying out this process.

Apparatuses of this type have already become known in a wide variety of designs (CS patent specification No. 115,022, GB patent specification No. 1,170,869 and German Offenlegungsschrift No. 1,901,442). The disadvantage of these apparatuses is either that during the reversal of the switching device, there is temporarily no delivery of fibers, so that they are left to themselves for a short time and can thus result in contamination of the machine to fly (Chech. patent specification No. 115,022), or that a valve is equipped with a flap-like or slide-like switching element which controls the path of the air and fibers. However, this switching element involves the danger that fibers will be caught or jammed and will then work free at an undesirable moment and penetrate into the spinning element, thus resulting in a fault in the spinning process which takes the form of a thread break, or at least an irregularity in the yarn in the shape of a thickened portion in the thread (GB patent specification No. 1,170,869 and German Offenlegungsschrift No. 1,901,442).

The purpose of the present invention is to avoid the abovementioned disadvantages and provide a process and an apparatus, by means of which reliable and uniform feeding of the fibers into the spinning element is guaranteed, while at the same time a switching device known per se is used for the fiber path.

This object is achieved, according to the invention because when the switching device is reversed, the fiber is taken out of the region of the particular fiber path to be blocked, and only then is this region blocked. Because the fiber flow is taken out of the region of the switching device which is blocked during reversal, even before this blocking operation is completed, it is impossible for fibers to be jammed here, since in this way there are no fibers in this region during the blocking of one of the two fiber paths. In principle, the fiber flow can be taken out of the region of the switching device to be blocked even before the start of reversal; however, in a case of an appropriate design of the switching device and/or of the fiber paths to the spinning element and into the delivery channel, it may also be sufficient if the fiber flow is prevented only in the last part of the reversing operation. It is merely necessary to ensure that the fiber path to be blocked is not yet blocked completely before the fiber flow has been taken out of this region. This ensures that those fibers still located in this blocking region from beforehand are delivered from this region before this fiber path is blocked completely.

Advantageously, when the fiber feed to the spinning element is blocked, that is to say when no fibers are in any case required in the spinning element for the spinning process, the fiber supply to the switching device is stopped, whereas, at least during the last part of the reversing operation to release the supply of fibers into the spinning element, the fibers are sucked out of the region of the reversing device which is to be blocked at the same time. On the one hand, because the fiber supply to the switching device is stopped and, on the other hand, because fibers are sucked out of the blocking region of the switching device, it is therefore impossible for fibers to be jammed in the reversing device.

Preferably, the fiber flow is influenced in the blocking region and consequently also the fibers are delivered from this region by controlling the volumetric flow rates of suction air through the switching device, and appropriately the cross-section of the fiber path leading to the spinning element is unblocked substantially more quickly than the cross-section of the fiber path leading into the delivery channel is closed. As regards coarse yarn, a relatively slow change in the fiber path, but in the ratio indicated, is sufficient here. Where fine yarns are concerned, it is advantageous if the cross-section of the fiber path leading to the spinning element is enlarged abruptly, whereas the cross-section of the fiber path leading into the delivery channel is reduced only gradually. As a result of the abrupt enlargement of the cross-section of one fiber path, the fiber/air stream passes suddenly into the fiber path leading to the spinning element, while at the same time, the fiber/air stream is prevented from penetrating into the delivery channel, the gradual reduction in the cross-section of the fiber path leading into the delivery channel effectively preventing fibers from being jammed. This effect is further assisted, according to the invention, if the fiber feed to the spinning element takes place essentially in a straight line, at least in the region of the switching device, while the fiber feed into the delivery channel takes place with the fibers being deflected in the region of the switching device.

According to a preferred form of the process according to the invention, when the spinning process has ended the fiber supply to the switching device, which is a control means, is stopped and at the same time or subsequently the rotor speed is reduced until the fibers located in a spinning rotor can be removed from the latter; or when the spinning operation starts, the supply of fibers resumes, but the fibers are first guided into the delivery channel, and the fiber feed into the spinning rotor is reversed shortly before or after redelivery of the thread into the spinning rotor, after the spinning rotor has been brought to a spinning speed again, whereupon the thread is doffed from the spinning rotor again. As a result, the spinning rotor is cleared of its ring of residual fibers and a positive refeeding of the fibers when spinning starts again is obtained, so that a high success rate and inconspicuous leaders in the pieced thread are achieved.

Admittedly, it is already known, when a thread break occurs, to stop the fiber supply by inactivating the feed roller and, during cleaning of the spinning rotor carried out before spinning starts, to feed to the rotor and remove from it, by allowing the feed roller to run for a short time, the end of the fiber strand which is shortened because of the continued action of the opening roller in a period of time after the fiber supply has stopped and which has fibers unsuitable for piecing (German Auslegeschrift No. 2,505,943). In this way, a fiber tuft of perfect quality will be available for subsequent piecing. However, since the fiber feed is interrupted again after the feed roller has been allowed to run for a short time, it is nevertheless impossible to prevent new damage to the fiber tuft caused by the opening roller continuing to run, so that it is not possible in this way to feed perfect undamaged fibers into the spinning rotor. At the same time, it must be remembered that approximately 80% of the fiber tuft will be shaved off within 5 seconds after the fiber supply has stopped. This disadvantage is avoided, according to the invention, because the fiber feed is switched on prematurely and the fibers loosened from the fiber tuft are delivered temporarily into the delivery channel.

In order, on the one hand, to ensure that the fibers damaged by the still running opening device are delivered after lengthly stoppages, and at the same time enable them to be kept separate from perfect or undamaged fibers, and on the other hand to improve the retention of the thread, resupplied to a spinning rotor when spinning starts, by individual fibers located in the spinning rotor, according to a further feature of the invention the procedure is that the fiber feed into the spinning rotor running at reduced speed is started and the fiber feed into the spinning rotor is interrupted, as a result of switching to the delivery channel, during the acceleration of the spinning rotor to its spinning speed.

To carry out the process, the spinning element and the delivery channel have assigned to them, according to the invention, control members which control the ratio between the vacuum in the housing receiving the spinning element and that in the delivery channel as a function of the change-over of the switching device. Adjustment of the ratio between the vacuum in the housing and that in the delivery channel as a function of the change-over of the switching device ensures that no fibers are located in the blocking region to be closed, at the moment when the fiber path leading into the spinning element or into the delivery channel is blocked. Switching members which can be actuated by the control members are preferably provided, and by means of these, the suction air stream can be conveyed alternately through the housing receiving the spinning element or through the delivery channel.

It has proved advantageous if the switching device has a closure region which breaks the connection between the supply device and the spinning element and which is located immediately after the branch-off of the delivery channel, the switching device being designed so that it controls the volumetric flow rates of air flowing to the spinning element and into the delivery channel. Appropriately, here, the fiber feed channel is essentially in a straight line from the supply device to the spinning element, at least in the region of the switching device, while the deliver channel is arranged at an angle to this fiber feed channel.

According to the invention, for the purpose of controlling volumetric flow rates of this type in a simple way, the switching device has, according to a simple advantageous design, at least one closing member with a first orifice which leads to the spinning element and the cross-section of which is enlarged geometrically in a discontinuous manner in the direction of the orifice opening, and with a second orifice which leads into the delivery channel and the cross-section of which is reduced geometrically in a gradual way in the direction of the orifice closure. Appropriately, for this purpose, both the fiber feed channel and the first orifice assigned to the latter and located in the switching device have elongate cross-sections, the larger diameters of which extend transversely to the directions of movement of the closing members of the switching device.

In a simple embodiment of the subject of the invention, these two orifices are controlled by means of a single closing member assigned to both the first orifice and the second orifice in common, and preferably the part of the closing member controlling the connection with the delivery channel is arranged laterally at a distance from the fiber path, which extends essentially in a straight line and which leads to the spinning element, and at the same time is designed as a guide element for the closing member.

So that the subject of the invention can be designed without the aid of additional switching elements for deflecting the suction air stream, and at the same time to enable the fiber loss to be kept to a minimum, according to a preferred design of the subject of the invention a stopping device known per se is assigned to the supply device. In addition to the simple control of the air stream, which becomes possible as result, because orifices are formed in the switching device, this stopping device can also perform a safety function for the supply device if appropriate monitoring devices are provided.

The subject of the invention is extremely advantageous since it makes it possible to piece a thread even at the full rotor speed, and at the same time even guarantees a high piecing success rate. These advantages are based on the fact that the obtainable leaders are of high strength and also have a relatively high degree of uniformity as regards their mass even in relation to the remaining thread. Furthermore, the subject of the invention is of simple construction, has high control accuracy and high operating reliability and can also be installed in existing open-end spinning machines without much difficulty, since it is sufficient to install an appropriately designed switching device in the fiber feed channel of a conventional device.

The invention is explained in more detail below with reference to examples. The drawings show:

Figure 6:
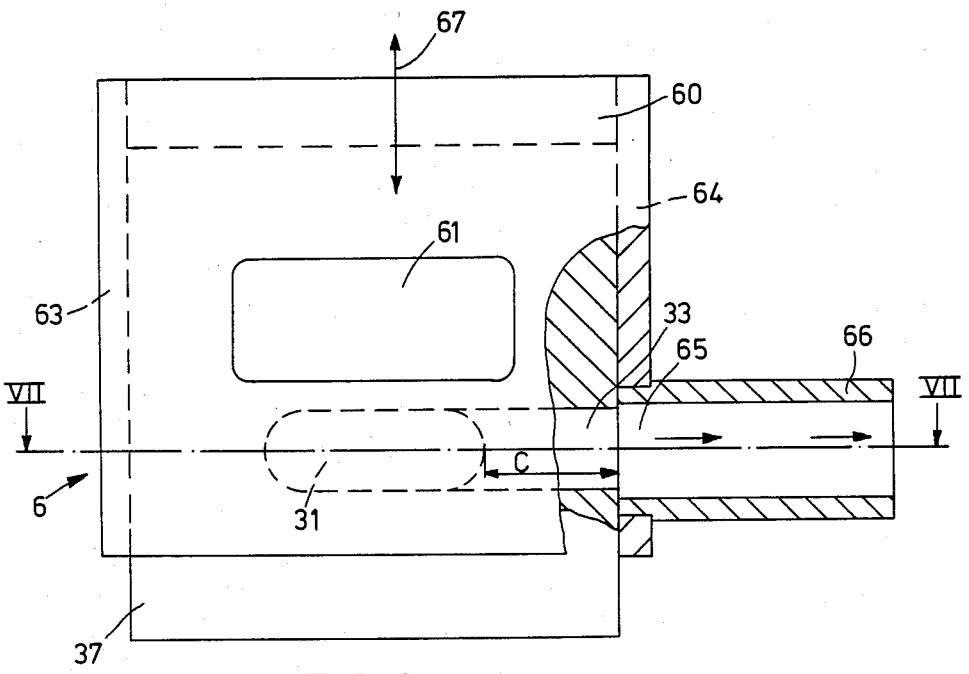
FIG. 6 shows a plan view of one of the end positions of a closure element which is modified compared to the closure element of the switching device shown in FIG. 5.
Figure 8:
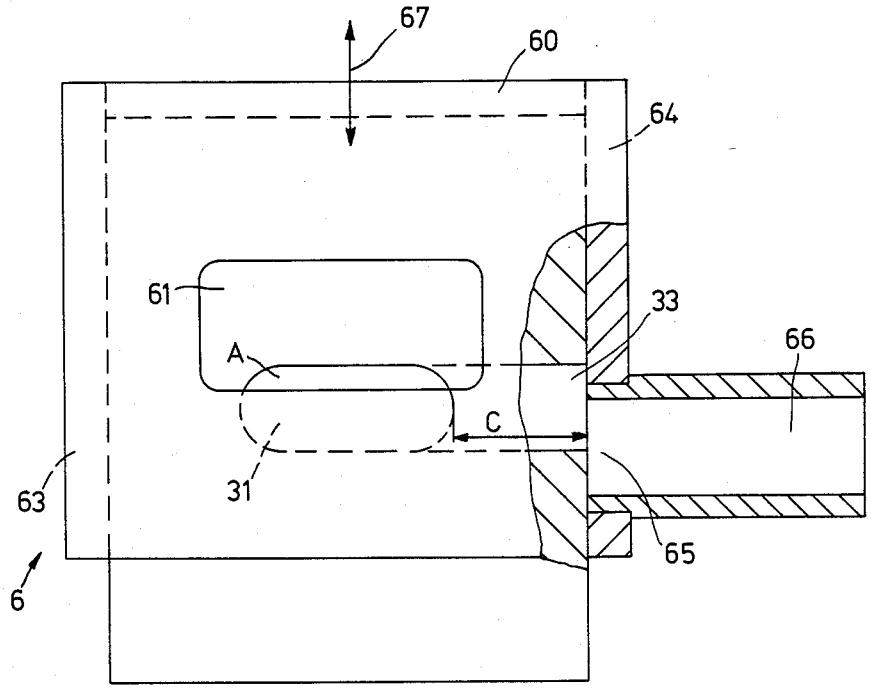
FIG. 8 shows a plan view of an intermediate position of the closure element shown in FIG. 6.
Figure 8A:
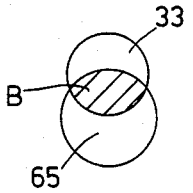
Figure 9:
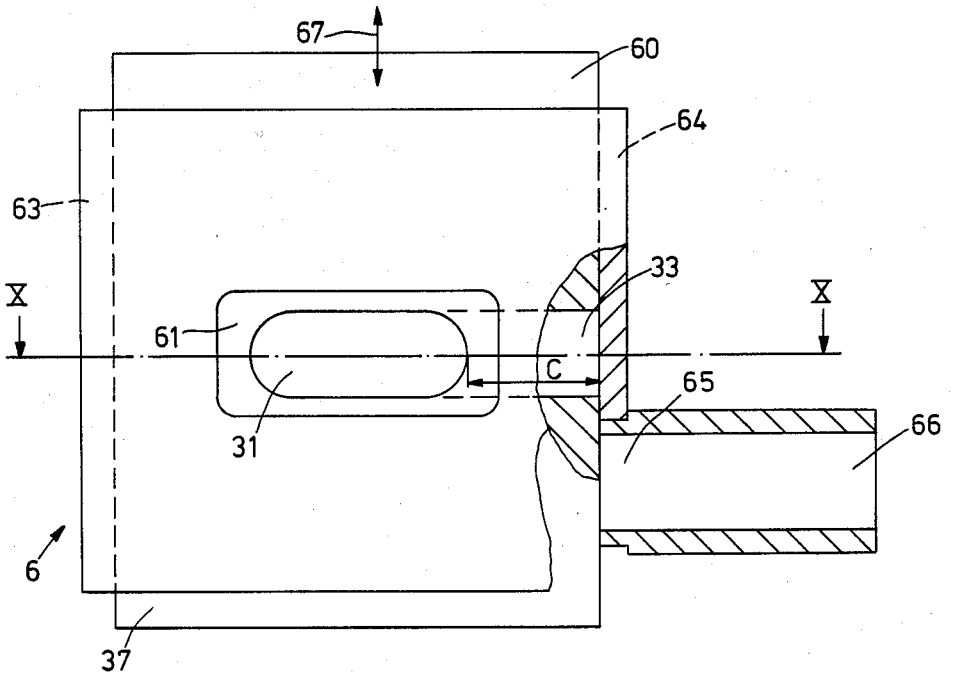
Figure 10:
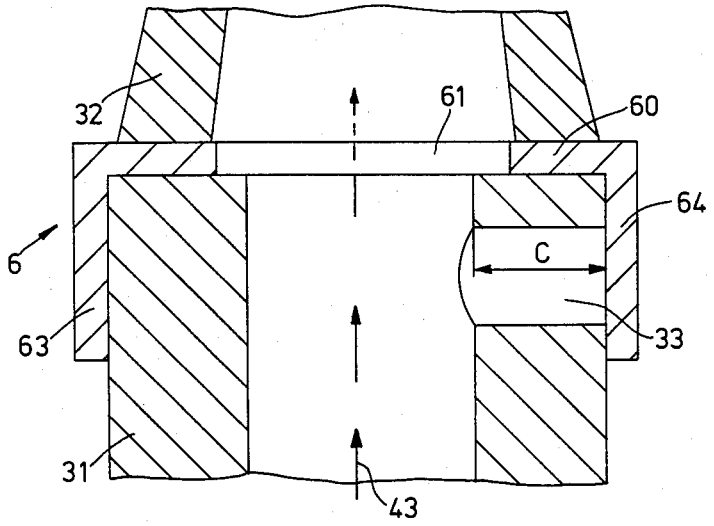

FIG. 8*a* shows diagrammatically the degree of opening of the fiber path shown side-on in FIG. 8, with the closure element being in the position shown in FIG. 8;

FIG. 9 shows a plan view of the other end position of the closure element shown in FIG. 6; and FIG. 10 shows a cross-section through FIG. 9.

Before the structural details of the subject of the invention are described, the process according to the invention will be described in more detail to assist better understanding of the subject of the invention.

The quality of the individual fibers supplied to the spinning element is of critical importance for a reliable start to spinning. To ensure good opening up of the sliver supplied to the opening device the rotational speed of the opening device must not fall short of a certain level. For this reason the opening roller must still have its working speed before interruption of the spinning process or must have already regained its working speed on resumption of the spinning process. If, for this reason, power is taken off the opening roller at the same time as off the feed device, it continues to run for a long time before it comes to a standstill; on the other hand, it must also be started up much earlier than the feed device; when repairing broken ends the rotational speed of the opening roller is not changed at all. This is the cause of the fiber tuft being shaved off and thus considerably damaged, which can only be alleviated but not avoided by intermittent running of the fiber feed and removal of the damaged fibers.

Figure 1:
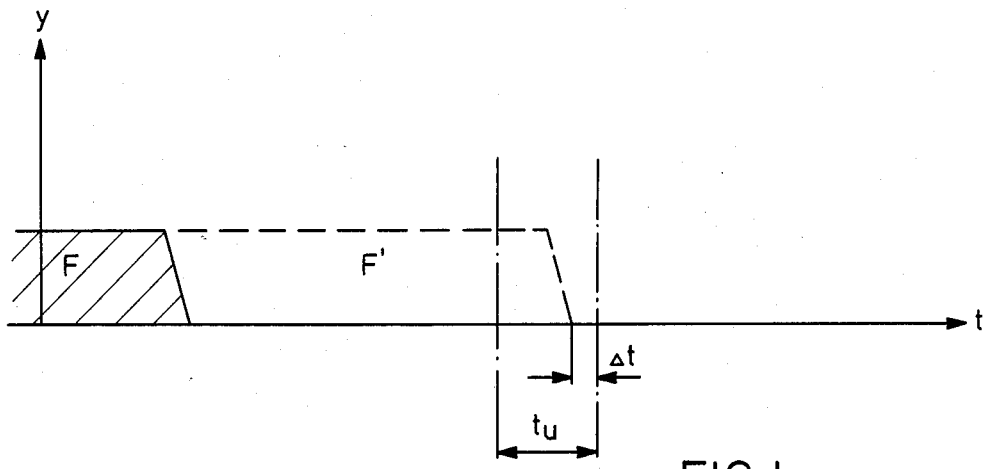
FIG. 1 shows diagrammatically the fiber flow in the blocking zone of the switching device.

These disadvantages can be avoided during the start of spinning by the fibers already being continually supplied by the feed device, without, however, passing into the spinning element, but being fed into a suction line until the start of spinning, and the subsequent spinning process, again requires fibers in the spinning element. However, this method harbors the danger that on switching from the fiber path leading to the outlet tube constructed as a suction line to the fiber path leading into the spinning element individual or several fibers will get caught in the blocking zone of the switching device and these caught fibers can hamper the function of the switching device or even be liberated at an undesirable time and produce an irregularity in the spinning process. To avoid the latter result, the fiber flow is affected so early according to FIG. 1 that is ceases in respect of the switching device zone to be blocked off in the switching even before the change-over is complete. FIG. 1 shows the switching device zone to be blocked, the amount of fibers F being supplied per unit time being plotted in the direction of the y axis, while time t is shown on the horizontal coordinate. As this figure clearly shows, the supply of fibers F to the switching device zone to be blocked is already blocked some time before the switching period $t_U$; at the latest the supply of fibers F (see F') to the blocking zone is finally concluded by the time $\Delta t$ before the end of the switching period $t_U$. The fiber flow is thus first removed from the particular fiber path zone to be blocked off before this fiber path is then completely blocked off after the fiber flow has been removed from this blocking zone, not only when switching the fiber path leading from the opening device to the spinning element to the fiber path leading from the opening device into the outlet tube but also when switching the fiber path leading from the opening device into the outlet tube to the fiber path leading from the opening device to the spinning element, that is in general to interrupt the supply of fiber to the spinning element or into the outlet tube. Blocking zone is here understood as meaning that position of a switching device which will be explained in more detail later where the fiber path is interrupted. It is only in this zone, where the fiber path is interrupted, that fibers can be trapped. It is thus possible for the fiber flow to be fully maintained at other points of the interrupted fiber path.

This basic method for interrupting the fiber flow in the blocking zone can be carried out in various ways. Since during an interruption (voluntary or involuntary) of the spinning process at a spinning position fibers are no longer required anyhow in the spinning element, it is most advantageous when interrupting the spinning process (for example when stopping the entire machine or when a broken end occurs) to discontinue the fiber feed to the switching device when blocking off the fiber supply to the spinning element. It is thus in any case ensured that when the fiber path is changed over fibers are not trapped.

As has already been explained above, when starting spinning the fiber feed is switched on even before the fibers are at all required in the spinning element, in order in this way to ensure that at the moment the spinning process is resumed in the spinning element there are satisfactory, undamaged fibers available. This means that it is impossible when starting to spin to change over the switching device with interrupted fiber feed. Nevertheless, to avoid trapping fibers in the blocking zone of the fiber path the fibers are sucked away from this zone of the switching device at least during the final part of blocking the fiber path leading into the outlet tube. According to FIG. 2 this is achieved by discontinuing the suction air stream a which passes into the outlet tube so rapidly that at time $\Delta_t$ before the end of switching period $t_U$ no more air passes through the switching device blocking zone allocated to the outlet tube, so that this place is then free of fibers. At the same time, the suction air flow b passed through the spinning element increases, so that fibers subsequently supplied by the fiber feed device pass into the spinning element. This control of the volumetric suction air flow rates through the spinning element and through the outlet tube affects fiber flow through the switching device in such a way that trapping of fibers is avoided.

Figure 5:
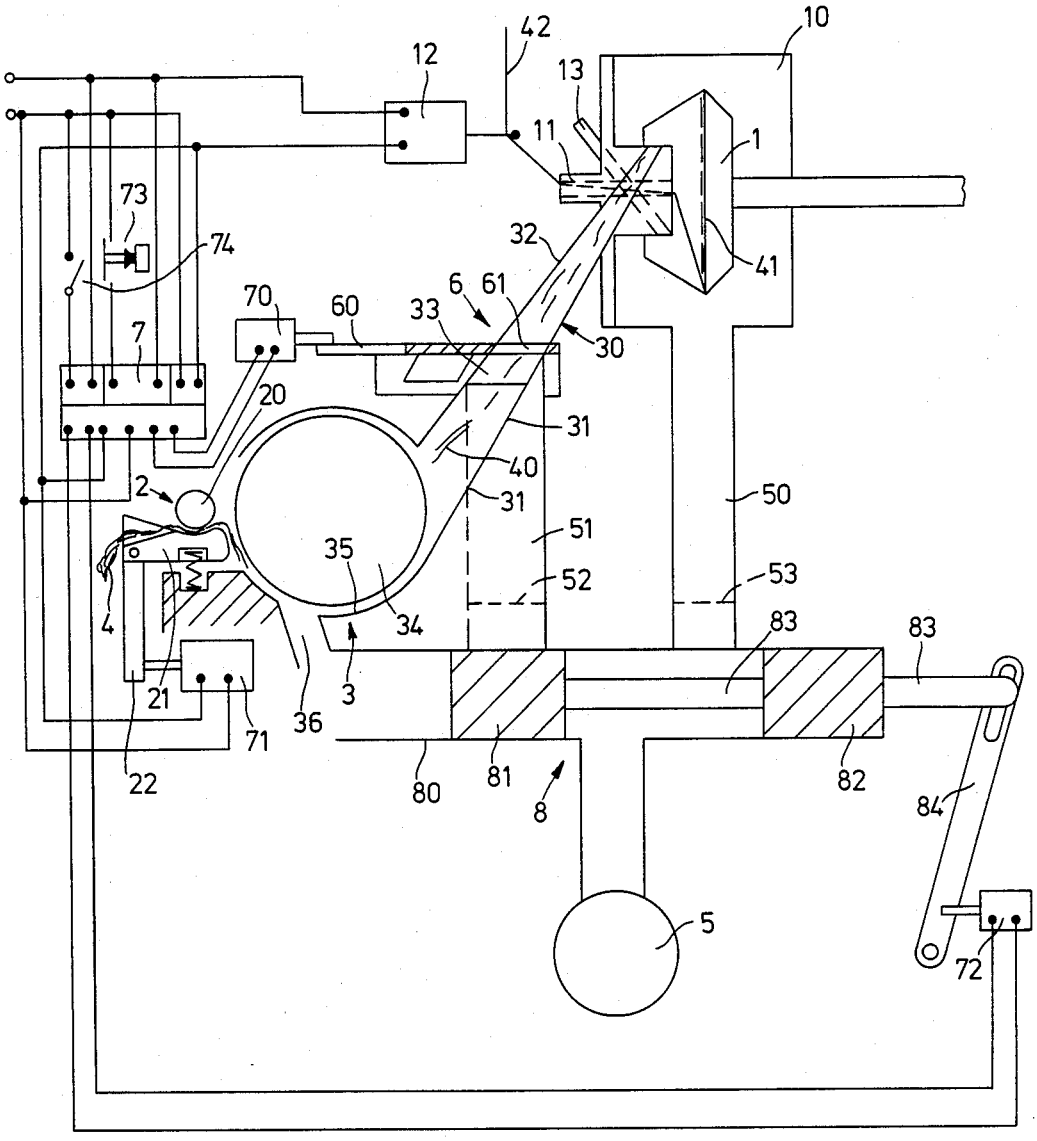
FIG. 5 shows a diagrammatic side view of an open-end spinning device constructed in accordance with the invention.

FIG. 5 shows a device for carrying out the process just described. The open-end spinning device shown has, for example, a spinning element which takes the form of a spinning rotor 1 and which is supplied, with the aid of a feed device 2 and an opening device 3, with a sliver 4 which has been opened up into individual fibers 40. In the spinning rotor 1, the individual fibers, 40, pass into the collecting groove, to form a fiber ribbon 41 there. The fiber ribbon, 41, is pieced up in a known manner to the end of a yarn 42 which is drawn off through a yarn take-up tube 11 by means of a pair of yarn take-up rollers (not shown) and wound up in a customary manner onto a bobbin (not shown). On its path to the bobbin the yarn, 42, is monitored by a broken-end detector, 12. The vacuum which must exist for spinning in the spinning rotor, 1, is generated in a known manner by an external source of vacuum, 5, which is connected to the housing, 10, for the spinning rotor, 1, via a tube, 50, which contains a filter, 53.

A switching device, 6, is located in the fiber feed path between the feed device, 2, and the spinning rotor, 1. According to FIG. 5, this switching device is present in the fiber feed tube 30 leading from the opening device 3 to the spinning rotor, 1, and subdivides the fiber feed tube, 30, into a first part, 31, and a second part 32. The switching device, 6, is also connected, via an outlet tube 51 (sometimes referred to as an evacuation channel), which contains a filter, 52, to the source of vacuum.

The switching device, 6, has a change-over element, 60, which, in the embodiment shown, is designed as a slide gate. The slide gate, 60, has a first opening, 61, by means of which the first part, 31, of the fiber feed tube 30 can be connected to its second part, 32, and a second opening, 62, by means of which the first part, 31, of the fiber feed tube, 30, can be connected to the outlet tube 51 via its opening 33. An electromagnet, 70, is provided as a drive for the slide gate, 60.

In the embodiment shown, the feed device, 2, has a driven feed roller, 20, and a feed trough, 21, which is pressed by a spring against the feed roller, 20, and on which a clamping lever, 22, can be brought to act, in order to be able to in this way trap the sliver, 4, between itself and the feed trough, 21, and to be able to swing the feed trough, 21, away from the feed roller, 20, so that fiber feed is discontinued. An electromagnet, 71, serves as a drive for the clamping lever, 22.

The tube 50 and the outlet tube 51 are not directly connected to the source of vacuum, 5, but, instead, a switching valve, 8, is provided, with the aid of which the source of vacuum, 5, is alternately connected to the tube 50 or the outlet tube, 51. According to FIG. 5, the switching valve, 8, is designed as a slide gate valve which has a cylinder, 80, and a piston which can slide within the cylinder and has two piston disks, 81 and 82, which are connected to each other and with a pivot lever, 84, via a piston rod, 83. An electromagnet, 72, is connected as an actuating drive to the pivot lever 84.

The three electromagnets 70, 71 and 72 are connected to a common control device, 7, in a manner by which they can be controlled, which can be actuated with the aid of the broken-end detector, 12, and two switches 73 and 74 and which remains switched on, in a manner not shown, for the period of the switching processes controlled by it and is then switched off. If desired, additional elements such as snap-in devices, snap-out devices and the like are provided for the individual units controlled by the control device 7 but are not shown since they do not constitute the essential part of the invention. The switch 73 can be actuated by hand, by a suitable auxiliary device, for example a piece-up device which can be moved along the machine, or the like, or even by the main control unit when setting the machine into operation.

The device described above with respect to its design will now be explained, by means of FIGS. 2 and 5, with respect to its functioning. It is assumed that the open-end spinning position is operating normally, so that feed device 2 supplies sliver 4 to the opening device, 3, which opens the sliver into its individual fibers, 40, which pass through the two parts 31 and 32 of the fiber feed tube, 30, into the spinning rotor, 1, where they collect in the form of a fiber ribbon, 41, which is finally drawn off through the yarn take-up tube, 11, as a spun yarn. The spinning vacuum which is necessary for this purpose in the spinning rotor, 1, is generated—as FIG. 5 shows—the housing 10 being connected to the source of vacuum, 5, via the tube 50 and the switching valve, 8.

Should a broken end occur now, the broken-end detector, 12, is actuated and immediately acts on the electromagnet 71 to interrupt the fiber supply to the opening device, 3, and thus to the spinning rotor, 1. At the same time, the broken-end detector, 12, also acts on the control device, 7, which in turn, after a fixed time, controls the change-overs of the switching device, 6, and of the switching valve, 8. In this way, while fiber feed is still interrupted, the control device, 7, actuates the electromagnets 70 and 72, so that the slide gate, 60, is shifted in such a way that the connection between parts 31 and 32 of the fiber feed tube, 30, is interrupted by the solid part of the slide gate, 60, while the opening 62 of the slide gate, 60, now gives access to the opening 33 in the fiber feed tube, 30, and so that, in addition, the piston disk 82 now covers the tube 50 and the piston disk 81 gives access to the outlet tube, 51, so that the outlet tube, 51, is now connected to the source of vacuum, 5. Synchronously with, or as a function of, an actuation of the switching device, 6, which alternately connects the feed device, 2, with the spinning rotor, 1, or the outlet tube, 51, the ratio of the vacuum in the housing, 10, for the spinning rotor, 1, relative to the vacuum in the outlet tube, 51, is thus controlled.

When changing over to the outlet tube, 51, has taken place, an external switching device, for example a travelling piecing-up device, or the, for example, manually actuated switch 73 disconnects the electromagnet 71 from the supply of electric current, so that the clamping lever, 22, in turn now releases the sliver, 4. The feed device, 2, now guides the sliver, 4, the front end of which is referred to as fiber tuft and has been considerably damaged through "shaving" by the opening device, 3, which is still running at full speed, to the opening device, 3, which now opens in a customary manner the sliver, 4, into its individual fibers, 40. The fiber path which leads to the spinning rotor, 1, through the part 32 of the fiber feed tube, 30, is interrupted, while the fiber path leading through the outlet tube, 51, is cleared. Individual fibers 40 which have been separated out of the sliver, 4, are thus sucked by the source of vacuum, 5, into this outlet tube, 51, and caught with the aid of the filter, 52.

Now the actual commencement of spinning can be carried out. For this purpose, the end of the broken yarn, 42, is returned in a known manner into the spinning rotor, 1, through the yarn take-up tube, 11, as a rule after the piece which effected the broken end has been separated from the yarn taken up on the bobbin. In a manner the timing of which is adapted to the return of the yarn the electromagnets 70 and 72 are now actuated via the switch 74 and perform their lifting movement in synchronized fashion, so that the piston disks 81 and 82 assume their position shown in FIG. 5 even before the slide gate, 60, has reached its end position shown in FIG. 5. In this way the vacuum in the switching device, 6, behaves as has been explained by means of FIG. 2. The vacuum prevailing in part 32 of the fiber feed tube, 30, has the effect that the individual fibers 40 subsequently supplied by the feed device, 2, pass into part 32 of the fiber feed tube, 30, even when the opening 33 which is connected to the outlet tube, 51, is not yet completely blocked off. In this way, individual fibers, 40, are prevented in the final part of the switching phase from passing into the blocking zone of switching device 6 and which has been formed by the slide gate, 60, so that trapping of individual fibers, 40, is effectively prevented.

Although it is in principle sufficient for the ratio of the vacuum in the housing, 10, which accommodates the spinning rotor, 1, relative to the vacuum in the outlet tube, 51, merely to change as a function of a switching of the change-over device, 6, in such a way that the suction air flow a and the suction air flow b take turns in prevailing within the change-over device, 6, it is nevertheless advantageous if—as described by means of the illustrative embodiment shown in FIG. 5—the suction air flow is passed alternately through the housing, 10, accommodating the spinning rotor, 1, and through the outlet tube, 51. In this step, several synchronously actuated valves or even a switching valve 8 designed as a multiway valve, or the like, can be used as switch elements which control the suction air flows a and b and which are actuated by the control elements formed from the broken-end detector, 12, the switches 73 and 74, and control device 7.

It is particularly advantageous if the fiber paths in the switching device, 6, are designed in such a way that the fiber feed path which it is intended to block off when fiber/air flow is present in the switching device, 6, has a deflection within the switching device, 6, while the fiber path to be cleared is arranged as a straight continuation of that part of the fiber path which is present upstream the change-over device, 6. The individual fibers, 40, which are intended to pass into the outlet tube, 51, must thus be deflected even before the slide gate, 60, while the individual fibers, 40, which are intended to pass into part 32 of the fiber feed tube, 30, can retain their previous direction of flight. Even the fact that the fiber supply to the spinning element, for example a spinning rotor 1, is essentially linear at least within the zone of the change-over device, 6, while the fiber supply into the outlet tube, 51, takes place with deflection of the individual fibers, 40, within the zone of the change-over device, 6, contributes to the fact that the fiber flow in the outlet tube, 51, is more rapidly interrupted and thus trapping of individual fibers, 40, effectively avoided than when the fiber flow guided through the outlet tube, 51, is guided in linear fashion.

The subject of the invention is of course not restricted to the embodiment explained above but can be modified in numerous ways. For example, the individual elements of the open-end spinning device can be replaced by other, equivalent means. Instead of using a spinning rotor, 1, it is thus also possible to use other mechanical, pneumatic, electrostatic or even other open-end spinning elements. The opening device, 3, need not be constructed as a high-speed opening roller, but can also be formed by the last roller pair of a drafting unit or can be designed in some other suitable manner. Even the feed device, 2, can be designed differently, for example as a feed roller, 20, and feed trough 21, as a pair of feed rollers, as a drafting unit feed with or without guide belt, and so on. Nor need the fiber feed be stopped with the aid of a clamping lever, 22, but, instead, a clutch can be allocated to the feed roller, 20, with the aid of which clutch the feed roller is separated from its drive.

In place of the depicted electromagnets 70, 71 and 72 it is also possible to use other elements as drive elements for the device elements to be controlled namely valves which control pistons, and so on.

The invention is similarly not restricted to a certain embodiment of the change-over device, 6, but this device can take the form of any embodiment which proves suitable. Accordingly, even the change-over element can be designed in different ways, for example as a slide gate or as a lid. It is also possible for the change-over device, 6, to be located at any point between the feed device, 2, and the spinning element, 1, even, if appropriate, in the shell of a housing accommodating an opening roller 34.

It is likewise unnecessary for it to be broken-end detector, 12, which actuates the change-over device, 6, in order to shift this device from the operating position, in which it connects the opening device, 3, with the spinning element, into the suction position, in which it connects the opening device, 3, with the outlet tube, 51, but this actuation can also be effected by a different switching element. Depending on the control program selected for the relative control of the electromagnets 70, 71 and 72 or of appropriate other drive units, other or even more or fewer triggering elements (for example time relays or the like) can be used in place of the switches 73 and 74.

When producing fine yarns it is necessary for as many fibers as possible to get into the spinning rotor as rapidly as possible in order to obtain good starting points on the spun yarn. For this purpose, the cross-section of the fiber path leading to the spinning element is abruptly enlarged, while the cross-section of the fiber path leading into the outlet tube, 51, is gradually reduced, so as to control the volumetric rates of flow through the spinning element, which is designed as, for example, a spinning rotor, 1, and into the outlet tube, 51 (see FIG. 5). For it has been found that in this way it is possible to dispense with the switching valve 8 and its control, so that the device according to the invention becomes even simpler in design. The fiber paths can in fact be controlled in a simple manner by the switching device, 6, itself, by, for example, rapidly restoring the connection between the parts 31 and 32 of the fiber feed tube, 30, while the opening 33 into the tube 51 is only gradually closed. This can be brought about by the switching device, 6, having two slide gates which are adjusted in an appropriate way relative to each other by the control device 7. However, this object can also be achieved by shifting the two slide gates at the same time with the same speed of response and shift, and that the opening in the switching device, 6, between the parts 31 and 32 of the fiber feed tube, 30, has such a shape that on shifting the slide gate allocated to the opening a large opening cross-section is cleared immediately and abruptly, while the opening 33 leading into the outlet tube, 51, has a shape such that on shifting the slide gate allocated to it the cross-sectional area of the opening is only gradually cleared. For this purpose not only the fiber feed tube 30 but also the associated first opening of the switching device, 6, have elongated cross-sections, for example rectangular shape, the larger diameter (or side) of which extends transversely to the directions of motion of the closure element of the switching device, 6, or, in other words, parallel to the covering edge of the slide gate, while opening 33 has the shape of a circle or of an oval and the smaller diameter extends parallel to the covering edge of the slide gate.

This result can of course also be achieved when the openings have identical cross-sections but the covering edges of the slide gates have contours matched to the desired effect.

In the case of coarse yarns the amount of fiber present in spinning rotor 1 at the moment when spinning is started must not be too large. It is therefore advantageous to supply individual fibers 40 only gradually to spinning rotor 1 in order to prevent a piece-up point on the yarn being formed as a thick place. For this purpose slide gate 60 is gradually moved from the by-pass position, in which the individual fibers, 40, pass into the outlet tube, 51, into the feed position, in which the fibers pass into the spinning rotor, 1. The predetermined ratio of the size of parts 31 and 32 of the fiber feed tube, 30, to the size of opening 33 ensures even in this case that individual fibers 40 cannot be trapped during the switching of switching device 6. As an alternative to the slide gate 60 moving gradually from its by-pass position into the feed position, this repositioning can also be carried out in several stages, in which the fiber feed tube, 30, is cleared and the opening 33 blocked in corresponding stages. Even then trapping of individual fibers 40 is effectively avoided, while, at the same time, a gradual increase in fiber feed into the spinning rotor, 1, is achieved.

This type of slide gate control is even appropriate when, to avoid tension peaks in the newly started yarn, this yarn is at first only taken up at a low speed from the spinning rotor, 1, and the yarn take-up speed is gradually raised to the full production speed. To avoid deviations in the yarn count (thick places) in this case, it is likewise advisable for the fiber feed to match the yarn take-up speed and gradually increase to production speed.

Figure 3:
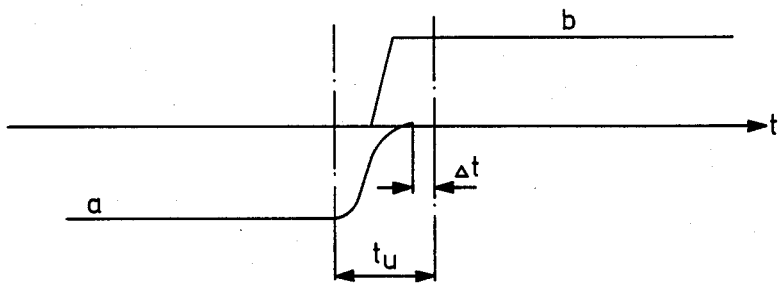
FIG. 3 shows diagrammatically the novel control of the air flows passing through the switching device when these air flows are controlled solely by the switching device.
Figure 7:
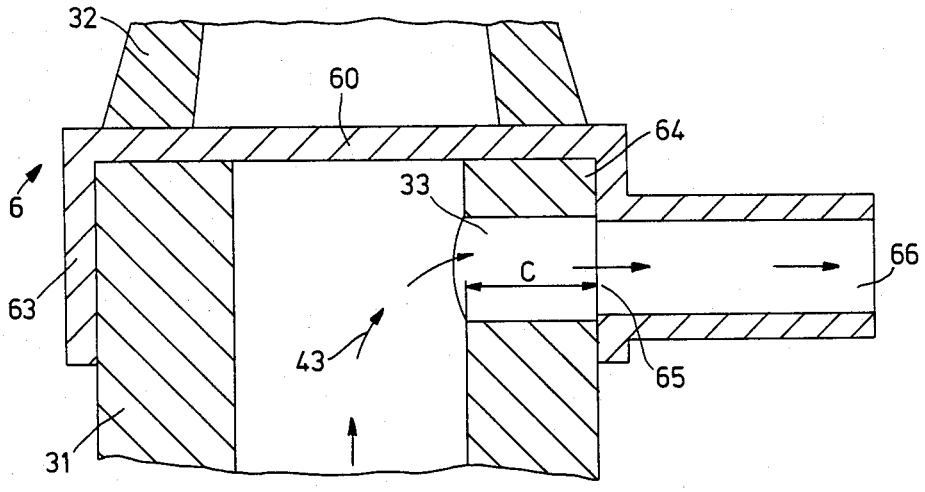
FIG. 7 shows a cross-section through FIG. 6.

A particularly advantageous embodiment of the subject of the invention to control the fiber supply path cross-sections in the manner described above is explained in detail below by means of FIGS. 3 and 6 to 10. FIGS. 6, 8 and 9 show a single slide gate, 60, which is viewed from part 32 of the fiber feed tube, 30, and which simultaneously controls not only the fiber path into the spinning rotor, 1, but also the fiber path into the outlet tube, 51. In contrast, FIGS. 7 and 10 show slide gate 60 in cross-section viewed from electromagnet 70. Finally, FIG. 3 shows the suction air flows a and b which pass through the two blocking zones of the switching device, 6.

As has already been mentioned, the suction air flows in tube 50 and in outlet tube 51 need not be controlled by a separate control element provided the changeover device, 6, is designed in an appropriate manner, so that these tubes can be connected to one or more sources of vacuum, 5, without a switching valve 8 having to be interposed.

As FIG. 7 shows, slide gate 60 is located between the two parts 31 and 32 of the fiber feed tube, 30, and has, parallel to the direction of motion 67, on both sides one guide surface each, 63 and 64, which embrace the external contours of the part 31 of the fiber feed tube, 30, in a positive manner. The slide gate, 60, has in its guide surface 64, which faces the diversion tube, 51, an opening, 65, which is connected to a pipe socket, 66, which in turn is connected to the outlet tube, 51, via flexible tubing (not shown).

The opening 33 in the part 31 of the fiber feed tube, 30, which opening is provided for connection to the outlet tube, 51, is located on the side of the fiber feed tube, 30, which faces the guide surface 64 of the slide gate 60.

As FIG. 6 shows, the part 31 of the fiber feed tube, 30, is located in a guide piece, 37, which advantageously is part of a housing accommodating the opening roller, 34.

During normal spinning, the slide gate, 60, has the position shown in FIGS. 9 and 10. The individual fibers, 40 (see FIG. 5), thus pass from the opening device, 3, through the fiber feed tube, 30, and through the opening 61 of the slide gate, 60 (see arrows 43), into the spinning rotor, 1, where they are spun in a customary manner into the end of the yarn, 42. The occurrence of a broken end or switching off the open-end spinning position or machine actuates the electromagnet 71 (via the broken-end detector, 12, or via another control position), pivoting the clamping lever, 22, and stopping yarn feed.

At any time before the fiber supply is switched on again, the slide gate, 60, is shifted from the position shown in FIGS. 9 and 10 into the position which is shown in FIGS. 6 and 7 and in which the air from the part 31 of the fiber feed tube, 30, passes into the outlet tube, 51, via the openings 33 and 65, the pipe section, 66, and the piece of flexible tubing (see arrows 43).

To restart spinning, the clamping lever, 22, is released by the electromagnet 71, and the clamping lever, 22, pivots backwards due to the action of a spring which is not shown, thereby releasing the sliver, 4. Individual fibers 40 thus released from the sliver, 4, now pass with the air into the outlet tube, 51, where they are trapped by the filter, 52 (see FIG. 5).

In order to avoid trapping individual fibers 40 when changing over the slide gate, 60, from the suction position of FIGS. 6 and 7 into the spinning position of FIGS. 9 and 10, the openings 61 and 31 have elongate cross-sections the larger diameters of which extend transversely to the directions of movement, 67, of the slide gate, 60, while, at the same time, the openings 33 and 65 have circular cross-sections (see FIG. 8*a*).

The slide gate, 60, is then shifted and clears the opening 61 of a partial cross-section of the part 31 of the fiber feed tube, 30, while, at the same time, the openings 33 and 65 are partially covered. Because of the cross-sectional shapes of the fiber feed tube, 31, and of the openings 61, 33 and 65 this very rapidly clears a large opening cross-section, A, while at the same time the opening cross-section B becomes very small (FIGS. 8 and 8*a*). This very rapidly raises the volumetric rate of flow of suction air b through the opening 61, and it has already reached a very large value before the volumetric rate of flow of suction air a through the openings 33 and 65 has reached zero (FIG. 3). The result is that the individual fibers, 40, follow the suction air flow b supplied to the spinning rotor, 1, even before the opening 33 is blocked off, so that no individual fibers, 40, are trapped in the blocking zone of the opening, 33.

To increase this preventive effect, the embodiment shown in FIGS. 6 to 10 provides for the fiber path from the feed device, 2, to the spinning rotor, 1, to be linear at least within the zone of the switching device, 6, while the fiber path from the feed device, 2, into the outlet tube, 51, is bent immediately before the blocking zone, formed by slide gate 60, of the fiber path leading to the spinning rotor, 1. Also, the blocking zone formed by the slide gate, 60, in the fiber path leading into the outlet tube, 51, is located at a distance c to the side of the fiber path leading to the spinning rotor, 1. This arrangement, namely at a distance c to the side of the fiber path leading straight to the spinning rotor, 1, is also advantageous in other embodiments of the switching device, 6, when its first and second openings do not have the cross-sectional shapes indicated.

Figure 2:
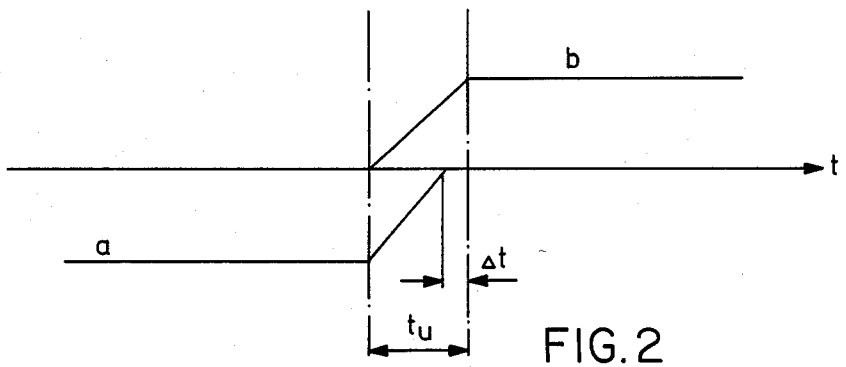
FIG. 2 shows diagrammatically the novel control of the air flows guided through the spinning element and outlet tube, as a function of the switching of the switching device when the air is controlled from outside the switching device.

The suction air flows a and b can be controlled independently of the specific embodiment of the changeover device, 6, according to FIGS. 2 or 3 or even in another way such that the suction air flow to be stopped has become insignificant before being blocked off in its blocking zone while, at the same time, the other suction air flow has become significant.

As described above, the suction air flows a and b can be controlled with the aid of a change-over valve, 8, or the like, so that the feed device, 2, does not require a stopping device and the clamping lever, 22, and its electromagnet, 70, can be dispensed with. However, on the other hand a stopping device for the feed device, 2, is very advantageous in order to, for example, be able to stop this feed device independently of actuation by the broken-end detector, 12. For this reason, the depicted and described embodiment of the subject of the invention allocates a stopping device to the feed device, 2, which is designed in a manner which is known in itself as a clamping lever, 22, or as a clutch allocated to the feed roller 20.

Figure 4:
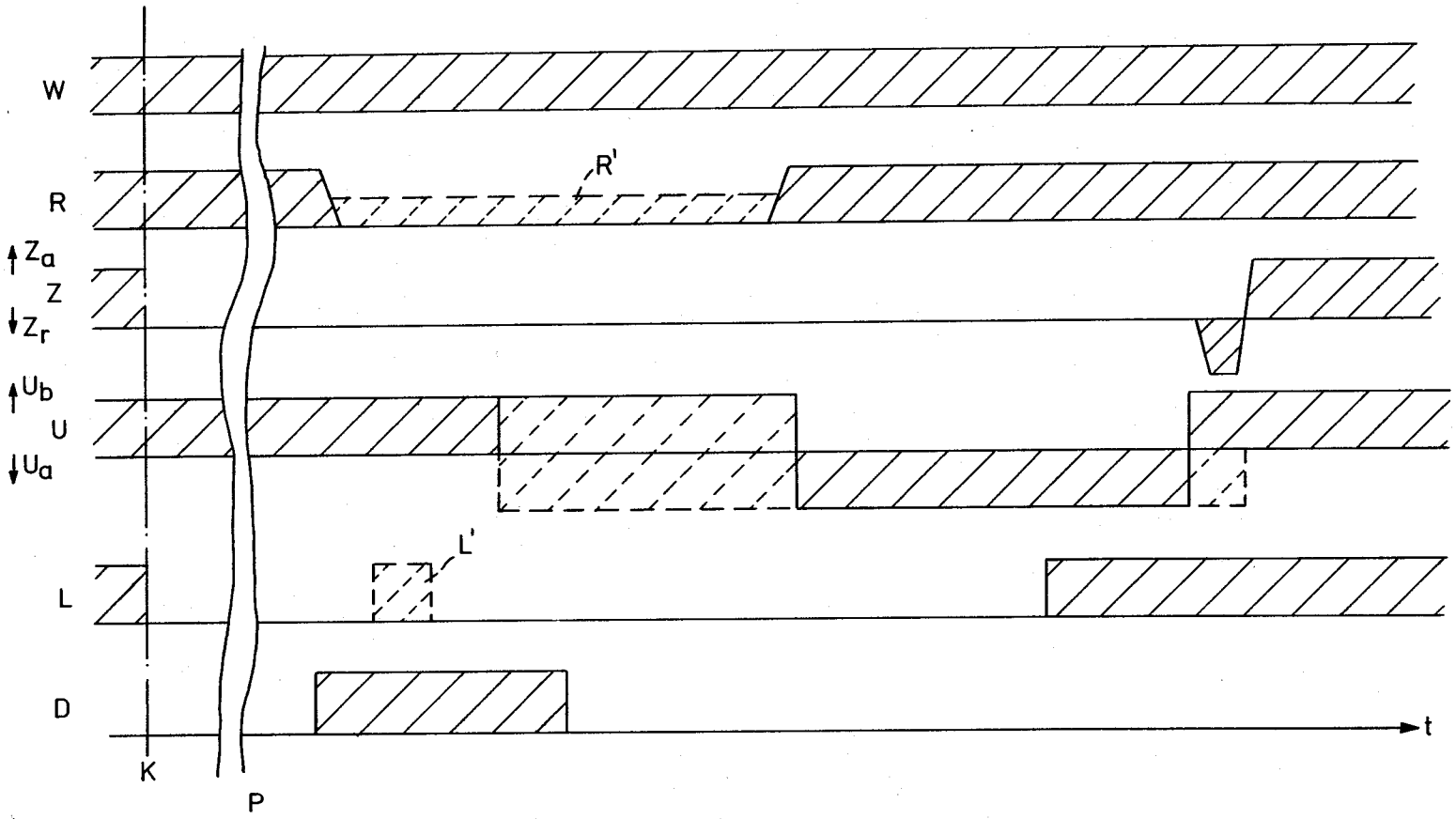
FIG. 4 shows diagrammatically the novel control of the air flows in conjunction with a broken-end repairer.

This detailed description of various processes will now be followed by a discussion, in conjunction with FIG. 4, of the process according to the invention in connection with repairing a broken end and cleaning the spinning rotor, 1. This cleaning is effected as customary by feeding a cleansing medium through a tube 13 into the interior of the spinning rotor, 1 (FIG. 5).

The labeling in FIG. 4 is as follows: W identifies the revolving opening roller 34, R the revolving spinning rotor 1, Z the yarn movement in general, with $Z_a$ identifying the yarn movement in take-up direction and $Z_r$ identifying yarn returning into the spinning rotor, 1, U the position of the switching device 6, where $U_b$ identifies the operating position of the switching device, 6, during spinning and $U_a$ identifies the suction position of the switching device, 6, during the fiber suction phase, L the fiber feed, D rotor cleaning, and K a broken end.

During normal spinning the opening device 3, the spinning rotor 1, the yarn take-up $Z_a$ effected with the aid of the take-up rollers, and the fiber feed L effected by the feed device 2 work at normal operating speed, individual fibers 40 being supplied to the spinning rotor, 1, by the switching device, 6, which is in operating position $U_b$. The supply of compressed air or of another medium for rotor cleaning, D, has been disconnected.

When a broken end K occurs, the yarn take-up Z in take-up direction $Z_a$ and the fiber feed L into the opening device, 3, and into the spinning rotor, 1, are stopped. After a standstill period P, which depends on the operator and/or machine-related details (for example automatic piece-up device which moves along the machine and the arrival of which must be awaited), the spinning rotor R is stopped or at least considerably reduced in its rotational speed (R') and the rotor cleaning operation D is switched on. During this time the fiber feed L can be briefly switched on again (L') in order to remove individual fibers 40 particularly severly damaged due to the opening roller, 34, which continues to run throughout the entire standstill period with the aid of normal rotor suction via the tube 50, and they are trapped by the filter, 53 (FIG. 5).

The fiber feed, L, is then interrupted again and, while the rotor cleaning operation D is still running or subsequently, the change-over device, 6, is changed over from the operating position $U_b$ to the suction position $U_a$. When the rotor cleaning operation D has ended, the spinning rotor, 1, is returned to its full operating speed (R) before or after the switching device, 6, has been changed over to the suction position $U_a$. At any time after the switching device, 6, has assumed its suction position, $U_a$, the fiber feed L is switched on and supplied individual fibers 40 are passed from the switching device, 6, into the outlet tube, 51, and are caught by filter 52. The actual restart of spinning, by returning the yarn 42 into the spinning rotor 1, is delayed until on renewed switching of the change-over device, 6, damaged individual fibers 40 can no longer pass into the spinning rotor, 1. Finally, yarn return $Z_r$ returns the yarn 42 up to the collecting groove in the spinning rotor, 1. Immediately before starting to return the yarn, 42, into the spinning rotor, 1, or within the time during which the yarn, 42, is already in contact with the collecting groove of the spinning rotor, 1, the switching device, 6, is returned into its operating position, $U_b$, so that individual fibers 40 are resupplied to the spinning rotor, 1. A fiber ribbon 41 then reforms in the spinning rotor. before or after the end of the yarn has reached the collecting groove of the spinning rotor, 1, depending on the chosen change-over time of switching device 6. The yarn, 42, can now be re-extracted from the spinning rotor, 1. The process of restarting spinning is complete.

Spinning can be restarted in a similar way also after a voluntary standstill of the open-end spinning device or machine. The open-end spinning device or machine is stopped in a customary manner. The opening roller, 34, and the spinning rotor, 1, are restarted in a customary manner, so that the spinning device or machine is in the same phase as after the standstill period P in repairing a broken end, whereupon the procedure for restarting spinning proceeds in the manner described in connection with broken-end repair.

If an intermediate supply of individual fibers 40 into the spinning rotor is intended, the fiber supply into the spinning rotor, 1, is advantageously only interrupted when, and the fiber supply into the outlet tube, 51, is only cleared when, the spinning rotor, 1, is being accelerated back to its full speed. The individual fibers 40 which thus pass into the spinning rotor, 1, increase the retention for the yarn 42 returned into the spinning rotor, 1, during the spinning restart and thus make it easier for the end of the yarn to be bound into the fiber ribbon, 41.

The temporary switching on of the fiber feed (L') when the spinning rotor, 1, is at standstill or revolving slowly and when the change-over device, 6, is in the operating position $U_b$, feeds the severely damaged individual fibers 40 to the filter 53 (FIG. 5), while those individual fibers 40 which have been damaged only slightly in the time from the intermediate feed L' to the resumption of the fiber feed L and the individual fibers 40 which have been supplied after resumption of the fiber feed L and which do not pass into the spinning rotor, 1, are supplied to the filter 52. In this way reusable individual fibers 40 are separated from non-reusable individual fibers 40.

On the other hand, it has also been found that a few individual fibers 40 which pass into the collecting groove and which in principle cannot contribute anything to the yarn strength are extremely advantageous for the restart of spinning.

The spinning-restart methods just described enable very high success rates to be achieved on restarting spinning even at high rotor speeds not only after a standstill of the open-end spinning device but also when repairing a broken end.

What is claimed is:

1. A process for interrupting and starting the spinning process at an open-end spinning station, in which the flow of fibers is controlled by means of a switching device being adapted to alternately assume one of two working positions, the first of which serving to give access to a duct leading to a spinning element and to block access to a fiber evacuation conduit, and the second of which serving to block access to said duct leading to said spinning element and to give access to said fiber evacuation conduit wherein, during switching of said switching device from one of said two working positions to the other of these two working positions, the fiber flow is first taken out of the zone to be blocked, and then the zone is blocked.

2. A process as claimed in claim 1, wherein when the fiber feed to the spinning element is blocked the fiber supply to the switching device is stopped, whereas, at least during the last part of the switching operation to release the fiber feed into the spinning element, the fibers are sucked out of the region of the switching device which is to be blocked at the same time.

3. A process as claimed in claim 1 wherein, to influence the fiber flow through the switching device, the volumetric flow rates of suction air flowing through said switching device is controlled.

4. A process as claimed in claim 3 wherein to control the volumetric flow rates, the cross-section of the fiber path leading to the spinning element is unblocked substantially more quickly than the cross-section of the fiber path leading into the delivery channel is closed.

5. A process as claimed in claim 4, wherein, to control the volumetric flow rates, the cross-section of the fiber path leading to the spinning element is enlarged abruptly while the cross-section of the fiber path leading into the delivery channel is reduced only gradually.

6. A process as claimed in claim 1 wherein the fiber feed to the spinning element takes place essentially in a straight line, at least in the region of the switching device while the fiber feed into the delivery channel takes place with the fibers being deflected in the region of the switching device.

7. A process as clained in claim 1 wherein the spinning element is a spinning rotor and, wherein, when the spinning operation has ended, the fiber feed to the switching device is stopped and at the same time or subsequently the rotor speed is reduced until the fibers located in the spinning rotor can be removed from the latter and, wherein, when the spinning operation starts, the fiber supply is started again, but the fibers are first guided into the delivery channel, and the fiber feed into the spinning rotor is reversed shortly before or after redelivery of the thread into the spinning rotor, after the spinning rotor has been brought to the spinning speed.

8. A process as claimed in claim 7, wherein the fiber feed into the spinning rotor running at reduced speed is started, and the fiber feed into the spinning rotor is interrupted as a result of switching to the delivery channel during the acceleration of the spinning rotor to its spinning speed.

9. An apparatus for interrupting and starting the spinning process of an open-end spinning station comprising:

a vacuum source;

a spinning assembly;

a fiber evacuation conduit;

a fiber supply device supplying a flow of opened fibers;

a control means for selectively connecting said vacuum source to said evacuation conduit and said spinning assembly for controlling the ratio between the vacuum in said spinning assembly and said evacuation conduit for controlling the flow of fibers to either said evacuation conduit or to said spinning assembly;

a switching means for selectively blocking said flow of fibers to a first path said spinning assembly or to a second path to said fiber evacuation conduit after said control means switched said flow of fibers to the other path.

10. The apparatus as set forth in claim 9 further comprising:

said control means including a switching member which can be actuated for alternately connecting said vacuum source to said spinning rotor assembly or said evacuation conduit.

11. An apparatus for controlling the flow of fibers in a spinning station of an open-end spinning device comprising:

a vacuum source producing a suction air stream;

a fiber supply device;

a spinning assembly;

a fiber feed channel connecting said supply device to said spinning assembly;

an evacuation channel and a switching device located in said fiber feed channel;

means for operating said switching device for selectively blocking the flow of fibers through a first path extending from said fiber supply device to said spinning assembly or through a second path to said evacuation channel after said vacuum has been connected to said path that is to remain open, said switching device including a closing member which breaks the connection between said fiber supply device and said spinning assembly and which is located immediately after said evacuation channel branches off of said fiber feed channel;

said switching device controls the volumetric flow rates of air flowing to said spinning and to said delivery channel.

12. The apparatus as set forth in claim 11 wherein said fiber feed channel extends essentially in a straight line from said supply device to said spinning assembly, at least in the region of said switching device whiles said evacuation channel is arranged at an angle to said fiber feed channel.

13. The apparatus as set forth in claim 11 further comprising:

said switching device having at least one closing member with a first orifice which leads to said spinning assembly and the cross-section (A) of which is enlarged geometrically in a discontinuous manner in the direction of the orifice opening, and with a second orifice which leads into the evacuation channel and the cross-section (B) of which is reduced geometrically in a gradual way in the direction of the orifice closure.

14. An apparatus as claimed in claim 13, wherein both said fiber feed channel and said first orifice assigned to said feed channel and located in the switching device have elongated cross-sections, the larger diameters of which extend transversely to the directions of movement of the closing members of said switching device.

15. An apparatus as claimed in claim 14 wherein there is a single closing member assigned to both said first orifice and the second orifice in common.

16. An apparatus as claimed in claim 15 wherein the part of said closing member controlling the connection with the evacuation channel is arranged laterally at a distance from said fiber path, extending essentially in a straight line and leading to the spinning assembly and is designed at the same time as a guide element for the closing member.

* * * * *